United States Patent [19]

Heinz

[11] Patent Number: 4,531,608

[45] Date of Patent: Jul. 30, 1985

[54] HIGH FREQUENCY COMPRESSION DRIVER

[76] Inventor: Harro K. Heinz, 27342 Via Amistoso, Mission Viejo, Calif. 92692

[21] Appl. No.: 437,515

[22] Filed: Oct. 29, 1982

[51] Int. Cl.[3] ..... G10K 13/00

[52] U.S. Cl. ..... 181/172; 181/170; 179/115.5 ES

[58] Field of Search ..... 181/157, 164, 170–174, 181/179, 158; 179/115.5 ES

[56] References Cited

U.S. PATENT DOCUMENTS 2,442,791 6/1948 Wente ..... 179/115.5 ES X 3,645,356 2/1972 Sotome ..... 181/172

4,324,312 4/1982 Durbin ..... 181/171

*Primary Examiner*—Benjamin R. Fuller

*Attorney, Agent, or Firm*—Knobbe, Martens, Olson & Bear

[57] ABSTRACT

A compression speaker driver has a relatively stiff, light weight diaphragm 11, including a dome portion and a rim portion around the periphery of the dome portion. The mounting plate 17 has an opening larger than the dome portion of the diaphragm 11, and a ring 31 is laminated to both the diaphragm 11 rim and to the mounting plate 17. Producing a composite compliance which prevents significant radial movement of the dome portion and which distributes the stress of flexing across the width of the compliance.

15 Claims, 8 Drawing Figures

HIGH FREQUENCY COMPRESSION DRIVER

BACKGROUND

The high frequency compression speaker driver of the invention relates generally to audio speakers intended to reproduce high frequency sounds at high acoustic output levels, and specifically to the diaphragms and their mounting structures used in high frequency compression drivers.

A compression driver consists of a light circular diaphragm having a spherical dome section suspended from a mounting plate. Firmly attached to the edge of the diaphragm's dome is a cylindrical former and wound on this is a coil of wire, the voice-coil. When a signal is applied to the coil, a force is exerted which causes the dome to move. The movement of the dome, responding to the variations in the electrical signal, sets up sound waves in the air.

To produce high frequencies, movement of the diaphragm must be in as straight a path axially as possible, with a minimum of flexing or distortion of the diaphragm itself, and a minimum of side-to-side (radial) movement. Moreover, a diaphragm's output will naturally decrease at high frequencies due to its mass, i.e., mass induced high frequency roll-off.

In all compression drivers the dome is attached to a mounting ring or base via a compliant material known as the "diaphragm compliance." The "compliance" allows the dome to move up and down in response to the electrical signal fed to the coil and centers the dome both vertically and horizontally.

An important aspect of the diaphragm's performance at high frequency is its dome resonance frequency. The dome resonance frequency is the dome's natural frequency of vibration. If the diaphragm is driven at this resonance frequency it will produce a greater output than it will if it is driven at a somewhat higher or a somewhat lower frequency. Therefore the resonance frequency can be utilized to partially offset the mass induced high frequency roll-off and thereby extend the useful range of a compression driver.

Resonance frequency is dependent upon the material and curvature of the dome. Thus, this frequency can easily be calculated from the properties of the material and the radius and length of the spherical section. Some of the materials used for construction of the diaphragm in high frequency compression drivers include aluminum, beryllium, and titanium. Heat treatable aluminum is a particularly good compromise for the diaphragm, as it is light-weight, relatively stiff, has a high fatigue strength, and has a high damping tendency that turns part of the unavoidable distortion of the moving diaphragm into heat, rather than into distorted sound.

As the use of audio speakers to reproduce music has increased in recent years, the need has arisen for drivers to reproduce frequencies up to 20 kHz with minimal distortion, while withstanding the power output of large amplifiers connected to electrical musical instruments. To the design engineer, the requirements for high frequency response coupled with high power handling present formidable challenges. High frequency performance requires light, low mass coils and diaphragms. On the other hand, high power handling is better served by substantial coils and diaphragms which, however, because of their very mass are inefficient at higher frequencies.

Because of this dilemma, the mid to high frequency range is usually divided into two bands and covered by physically different driver units. The lower end (mid-range) is serviced by drivers with relatively heavy diaphragm assemblies, the high end is covered by drivers equipped with light diaphragms and small diameter coils. Several of the smaller drivers are then required to match the output of each of the large mid-range units. The solution is reliable, but not altogether satisfactory, because of the obvious penalties in cost, size and weight.

In the past, efforts have been made to couple high frequency response with high power handling in a single compression driver unit. The assignee of the present application, Renkus-Heinz, Inc. in its drivers bearing model numbers 1400, 1800, and 3300, attaches a silicon compliance ring around the perimeter of the aluminum dome and to the mounting plate. While having the advantage of being resistant to fatigue, the silicon compliance is not restrictive in the radial direction of the diaphragm, and thus has little influence on the resonance frequency of the dome. Since the compliance does not significantly affect the resonance frequency, the compliance cannot be used to adjust the resonance frequency to a more desired position in the frequency spectrum to increase the high frequency performance of the diaphragm. The resonance frequency is determined substantially only by the properties of the dome material and the curvature chosen for the dome.

Pioneer Electronics Corporation of Japan offers compression drivers that are constructed similarly to the Renkus-Heinz drivers just described, with a dome of a light, stiff material held by a soft suspension or compliance. But, rather than using aluminum for the dome, the Pioneer drivers have used beryllium for the dome. Beryllium is lighter and stiffer than aluminum; thus the moving mass of the diaphragm is reduced and the resonance frequency of the dome is increased which extends the high frequency performance of the driver. But, the cost of manufacturing these drivers with beryllium domes is quite high. Also, beryllium is quite brittle and shatters easily on application of a large amount of power. This tendency to shatter makes the beryllium domes unreliable for high power applications. Also, the beryllium has a high "Q" factor, which means that distortions in the dome are not damped and converted to heat, and thus the dome distortion produces high audible distortion. Further amplification of the Pioneer drivers is found in "The Influence of Parasitic Resonance on compression driver loudspeaker performance" by Shozo Kinoshita et al. preprint No. 1422(M-2) by the Audio Engineering Society 1978 and "Design of 48 MM Beryllium Diaphragm Compression Driver" by Shozo Kinoshota et al., preprint No. 1364 (D-9) by the Audio Engineering Society 1978 which are herein incorporated by reference.

James B. Lansing Sound, Inc. (JBL) of Northridge, Calif. has constructed drivers using aluminum for the dome, and forming with the diaphragm dome an annular compliance of aluminum consisting of a series of pyramid-like structures that give the compliance flexibility in the axial direction, but stiffness in the radial direction. The radial stiffness of the compliance produces a higher resonance frequency for the diaphragm, and improves the high frequency performance of the device. The JBL device is disclosed in U.S. Pat. No. 4,324,312 to Durbin. But, the corner at which the dome portion of the diaphragm merges into the compliance portion is sharp, with the result that most flexing of the compliance occurs at this corner. The eventual fatiguing of the aluminum causes the dome-to-compliance boundary to fail. To solve this reliability problem, JBL has switched to using titanium for the dome and compliance combination of the diaphragm. But, titanium is much heavier than aluminum, which increases the mass of the diaphragm and consequently worsens the high frequency performance of the diaphragm. Tilanium also has relatively high "Q" and therefore produces audible distortion.

There is, therefore, a need for single compression units which economically combine high frequency performance with high power handling using materials that result in low overall distortion.

SUMMARY OF THE INVENTION

An improved compression speaker driver comprises a diaphragm having a dome portion and an annular rim portion. The diaphragm is suspended by means of a composite compliance which substantially reduces radial movement of the diaphragm and prevents the annular rim portion from bending (creasing) by spreading the axial flexing across the width of the compliance. Secondly, the diaphragm has a vertical step portion for permitting controlled radial movement of the perimeter of the dome portion so that resonance frequency of the diaphragm can be adjusted independently of the materials and curvatures chosen for the dome. A third aspect of the inventive driver is that the corners in the diaphragm which form the step portion are reinforced to prevent any fatigue of the diaphragm at these higher stress points.

Specifically, the composite compliance comprises the rim portion of the diaphragm, bonded to a resilient polymeric ring or substrate in turn bonded to the mounting plate. This compliance prevents the diaphragm from experiencing any significant radial movement. As a result, the resonance frequency occurs at higher frequencies than in prior art drivers using a silicon compliance.

The ring, which acts as a radially rigid substrate for the diaphragm rim portion prevents the rim portion from developing creases as the diaphragm moves up and down. In other words, the composite compliance flexes relatively uniformly across its width, spreading the flexing stress of the vibration of the diaphragm across the width of the compliance and eliminating localized stress at any one point which would develop if aluminum alone were used. As a result, failure at any one point is extremely unlikely.

The step portion of the diaphragm between the rim portion and the dome portion allows convenient placement of the dome resonance for optimum performance by permitting controlled radial movement of the dome. The resonance frequency of the diaphragm can thereby be adjusted for maximally flat and extended frequency response.

The compression speaker driver constructed according to the invention has an optimally positioned dome resonance frequency because of the combination of the radial stiffness of the compliance and the step portion and thus exhibits excellent high frequency performance while at the same time maintaining a high degree of reliability.

Advantageously, the coil support is extended upwardly along the interior surface of the dome and is affixed to the dome interior in the region of the step portion to provide stiffening of that region and prevent the corners in the step from failing.

The driver is composed of a heat treatable aluminum material which has a low Q factor that resists fatigue and reduces distortion.

Finally the driver in achieving high output at high frequencies accomplishes this economically with readily available materials.

These and other advantages will be amplified in the discussion below with references made to the following drawings:

DETAILED DESCRIPTION

Figure 1:
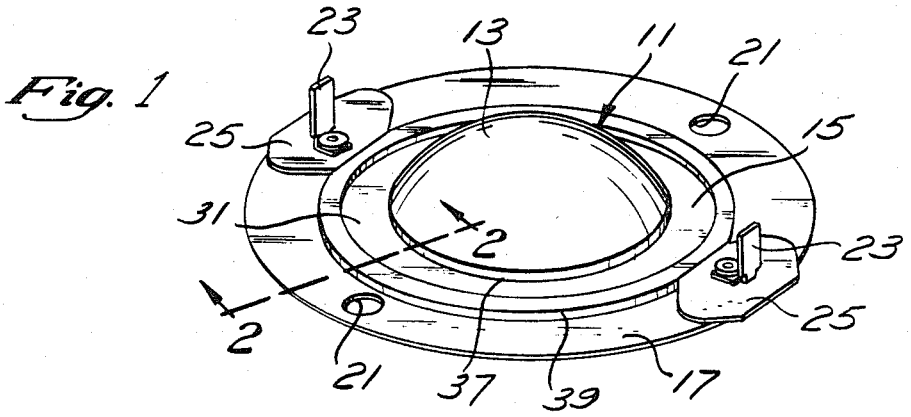
FIG. 1 is a perspective view of the preferred embodiment of the compression speaker driver.

The preferred embodiment of the invention shown in FIG. 1 includes a stiff, light weight diaphragm 11. The diaphragm 11 is formed as a unit with a dome portion 13 and a rim portion 15 around the periphery of the dome portion 13. The annular lip or rim portion 15 extends radially outward from the substantially circular dome 13. The diaphragm 11 is best made of fatigue resistant heat-treatable aluminum of the type used in aircraft wing construction. A mounting plate 17 has an opening 19 (see FIG. 2) that is larger than the dome portion 13 but smaller than the rim portion 15 of the diaphragm 11. The mounting plate 17 also has openings 21 for alignment to the speaker structure. Electrical connections 23 on the mounting plate 17 can be attached to the signal source for the speaker. The electrical connections 23 on the mounting plate 17 are electrically isolated from the plate 17 by insulating pads 25. A cyclindrical coil support 27 (FIG. 2) is bonded to the inner surface of the diaphragm 11. A voice coil 29 is attached to the coil support 27.

Figure 2:
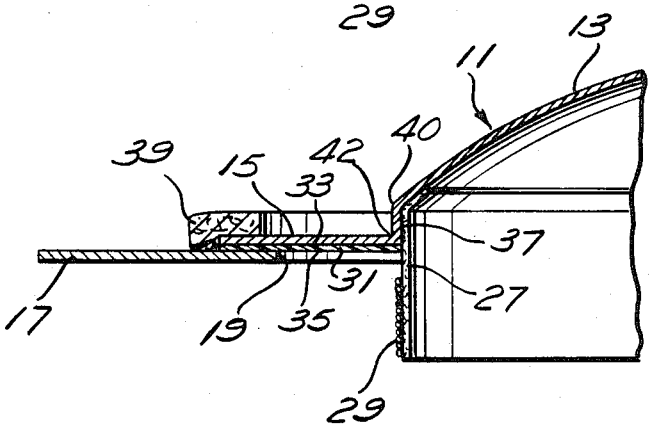
FIG. 2 is a cross-sectional view of a portion of the preferred embodiment of the compression speaker driver taken along line 2—2 of FIG. 1.

The rim portion 15 of the diaphragm 11 is laminated to a ring or substrate 31. The ring 31 is also bonded to the mounting plate 17. Referring to FIG. 2, the ring 31 has a pair of opposed, substantially parallel upper and lower faces 33, 35. The width of each face 33, 35 is greater than the thickness of the ring 31 between the faces 33, 35. The laminated combination of ring 31 and the rim portion 15 forms the compliance which is more flexible in a direction substantially perpendicular to the plane of the ring 31 and the rim portion 15 than in a radial direction. This flexibility ensures that during operation the dome portion 13 of the diaphragm 11 can move in an axial direction, substantially perpendicular to the plane of the mounting plate 17, but radial movement of the rim portion 15 in the plane of the mounting plate 17 is virtually eliminated. The resistance to radial movement is due to the formation of the rim portion 15 as well as the radial stiffness of the ring 31. The rim portion must therefore have a sufficient width to prevent substantial radial movement of the dome. The limitation on the radial movement increases the reasonance frequency of the dome 13.

The entire laminated diaphragm rim 15 and the ring 31 structure forms a flexible compliance between the diaphragm 11 and the mounting plate 17. This composite nature of the compliance assures flexing essentially uniformly across the width of the ring 31. Localized stress is reduced, which reduces the chance of stress failure of either the diaphragm rim 15 or the ring 31, and therefore increases the reliability of the compliance. The ring 31 must therefore be thick enough to form a radially stiff substrate beneath the rim portion 15. In this way, the ring 31 prevents the rim portion 15 from developing localized stress points that would tend to fatigue.

In forming the step portion 37 two relatively sharp corners 40 and 42 are formed. These corners 40, 42 represent stress points which could fail with extended use. To prevent this, the coil support 27 extends upwardly along the interior of the dome 13 to a point above the highest corner 40. The coil support 27 therefore traverses the entire region from the corner 40 to the corner 42, inclusive. The cylindrical coil support 27 with the attached voice coil 29 substantially increases the rigidity of the relatively sharp corners 40, 42 formed by step 37. Without the coil support 27 affixed to the dome in this region, the sharp corners 40, 42 leading into the step 37 from both directions would tend to flex relatively more than the compliance, thereby causing the dome 13 to eventually separate from the laminated compliance.

The bonding of the coil support 27 to the inner surface of the step portion 37 gives the diaphragm rigidity and ensures that a minimum of flexing occurs in this area. Consequently, as the diaphragm moves axially, virtually all bending and flexing is distributed across the width of the ring 31 and rim 15.

The material of which the ring 31 is formed must be resilient in an axial direction to permit dome resonance without failure and must also be essentially radially stiff to protect the rim portion 15 from bending. An excellent material of which to make the ring is Kapton TM, a polypyromelitimide manufactured by DuPont, E. I. de Nemours & Co., Inc., Wilmington, Del.

As shown in FIG. 2, the ring 31 has an inner diameter that is smaller than the outer dimension of the diaphragm rim 15, and an outer diameter that is larger than the mounting plate opening 19. The rim portion 15 of the diaphragm 11 is bonded to the face 33 of the ring 31 to laminate the diaphragm rim 15 to the ring 31. At least a portion of the opposing face 35 of the ring 31 is bonded to the mounting plate 17 around the perimeter of the mounting plate opening 19 to affix the composite compliance to the mounting plate 17.

An additional element of the preferred embodiment is the cylindrical step portion 37 of the diaphragm 11 between the rim portion 15 and the dome portion 13 of the diaphragm 11. The step portion 37 is substantially perpendicular to the rim portion 15. The cylindrical step portion 37 allows adjustment of the resonance frequency of the dome 13 by decoupling the dome from the radially stiff compliance. The amount of the decoupling can easily be controlled by the height of step 37. At frequencies higher than the resonance frequency of the dome 13 the performance of the diaphragm 11 drops off sharply. As the size of the step 37 is increased, the resonance frequency is reduced. However, the response of the diaphragm 11 at frequencies less than the resonance frequency is increased.

A protective bumper 39 of cardboard or other nonresilient material is attached around the outer perimeter of the ring 31. This bumper 39 seals the back chamber of the driver structure which has an effect on low frequency behavior.

First Alternate Embodiment

Figure 3:
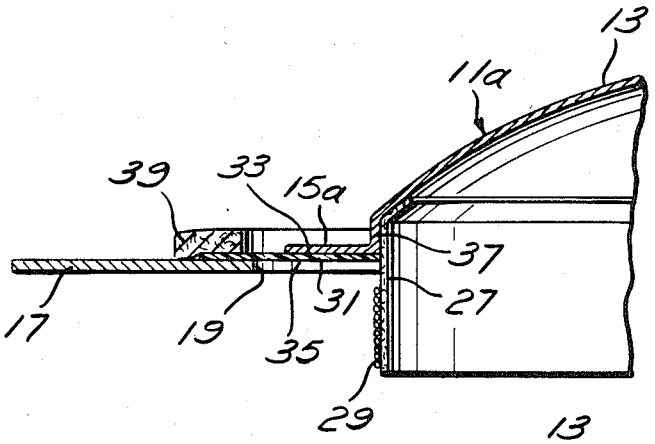
FIG. 3 is a cross-sectional view of a portion of a first alternate embodiment of the compression speaker driver.

The first alternate embodiment of the invention shown in FIG. 3 provides the diaphragm **11*a* with a more compliant hinge between the diaphragm 11*a* and the mounting plate 17. The rim portion 15*a* of the diaphragm has an outer dimension smaller than the mounting plate opening 19, so the rim portion 15*a* of the diaphragm does not overlap the mounting plate 17. Thus, the ring 31 laminated both to the diaphragm rim 15*a* and to the mounting plate 17 is reinforced only partially across its width by the relatively stiff diaphragm rim 15*a***. The more compliant hinge, thus formed allows the resonance frequency of the compliance/dome assembly to be lowered within a smaller mounting ring cut-out. This arrangement has no effect on the high-frequency performance; it allows however, a smaller diaphragm assembly with essentially identical performance.

Second Alternate Embodiment

Figure 4:
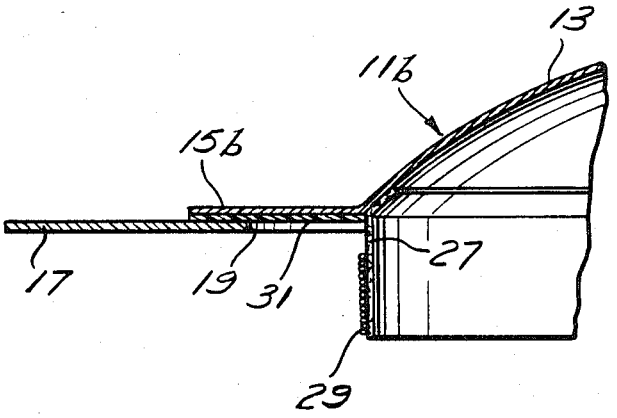
FIG. 4 is a cross-sectional view of a portion of a second alternate embodiment of the compression speaker driver.

In the second alternate embodiment shown in FIG. 4, the step portion 37 of the diaphragm **11*b* is eliminated. As discussed above, in connection with the preferred embodiment, as the size of the step is reduced, the resonance frequency of the dome 13*b* is increased, although the performance of the diaphragm 11*b*** at frequencies below the resonance frequency is impaired. For this reason, this embodiment is not as advantageous as those having a step. This second embodiment has, however, the advantage of lower cost production. It therefore represents a trade off of performance against cost.

Performance of the Invention

Figure 5:
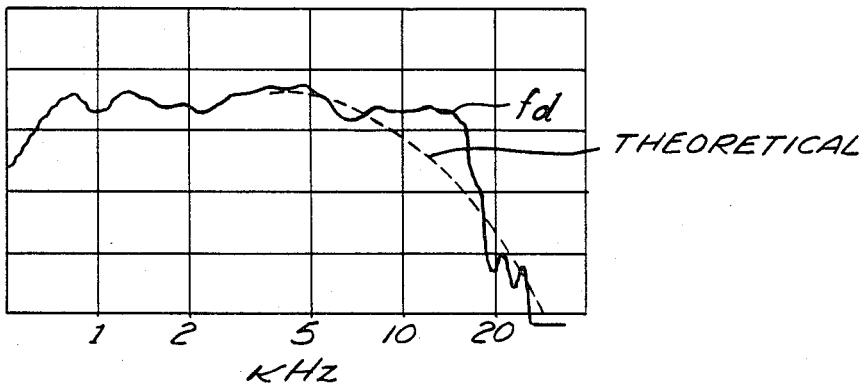
FIG. 5 is a graphic representation of the frequency response of a typical diaphragm of the prior art illustrating the beneficial effects of dome resonance on output against theoretical roll-off induced by mass only.

Referring now to FIGS. 5–8, the benefits of the invention are seen. Referring first to FIG. 5, the frequency response performance of the prior art Renkus-Heinz Compression Driver Model No. SSD1800 is shown as compared with the theoretical curve. The resonance frequency of the diaphragm, above which performance of the diaphragm is sharply reduced, is evident at about 15 kHz. Without the resonance the frequency response would follow the theoretical dashed line. With the resonance, response of the unit up to 15 kHz is quite flat, a desired characteristic of speaker drivers to obtain a balanced sound across the frequency spectrum. But, performance at frequencies above the resonance frequency of 15 kHz is sharply reduced, resulting in the loss of sound at these higher frequencies that are, nevertheless, still within the audible range. Thus, it is desired to increase the resonance frequency to obtain the benefit of extended frequency response.

Figure 6:
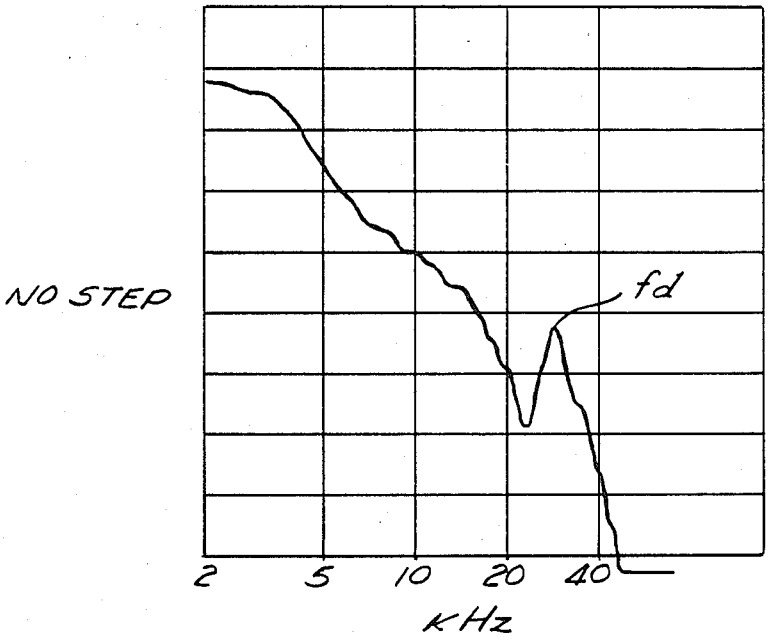
FIG. 6 is a graphic representation of the frequency response of the second alternate embodiment of the compression speaker driver of the invention.

Referring to FIG. 6, the frequency response of the dome-shaped diaphragm with the ring laminated to the diaphragm rim according to the second alternate embodiment of the invention (with no step portion 37) is shown. The resonance frequency of the dome is considerably higher with this diaphragm and compliance structure than with that illustrated in FIG. 5 because of the radial stiffness of the compliance. The radial stiffness ensures that movement of the dome portion 13 of the diaphragm 11 is axial at frequencies up to almost 22 kHz. The diaphragm tends to vibrate or resonate at a higher frequency because of the reduced range of radial diaphragm movement. Thus, the diaphragm has a higher resonance frequency than diaphragms in which radial movement is not so significantly restricted. Specifically, the resonance frequency of this embodiment of the invention is approximately 28 kHz. Thus, while performance of the diaphragms of the prior art was virtually zero at frequencies above 20 kHz, the diaphragm constructed according to the second alternate embodiment of the invention has significant response at frequencies up to about 30 kHz. Moreover, the laminated compliance construction of the diaphragm which distributes bending stresses across the width of the compliance, substantially increases the reliability of the device. Thus, the diaphragm constructed according to the invention does not have the reliability problems associated with some of the diaphragms previously constructed that had relatively good high frequency performance. However, output from 10 kHz to 17 kHz is lower than in the older Renkus-Heinz driver which had a dome resonance of about 15 kHz.

Figure 7:
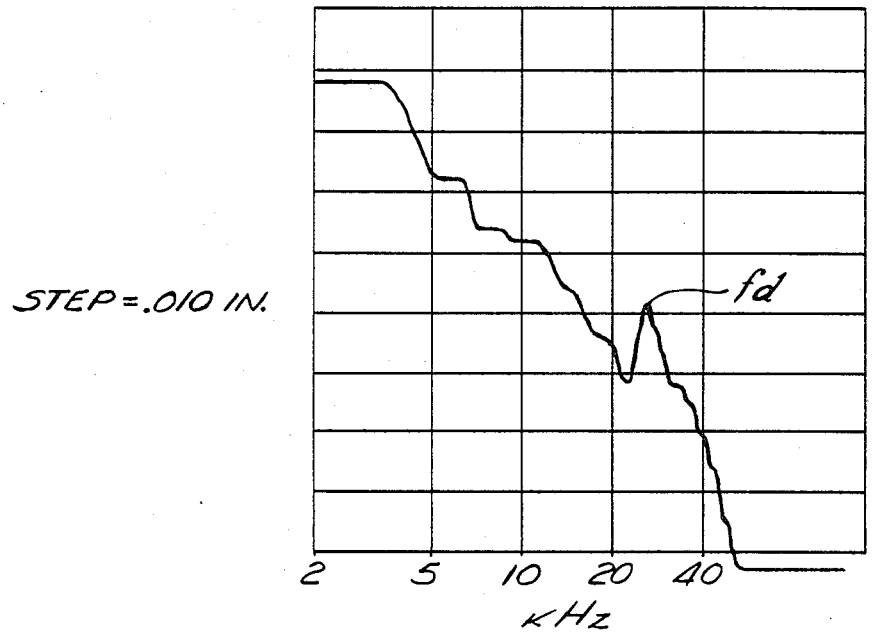
FIG. 7 is a graphic representation of the frequency response of an embodiment of the compression speaker driver having a step portion of 0.01 inches.
Figure 8:
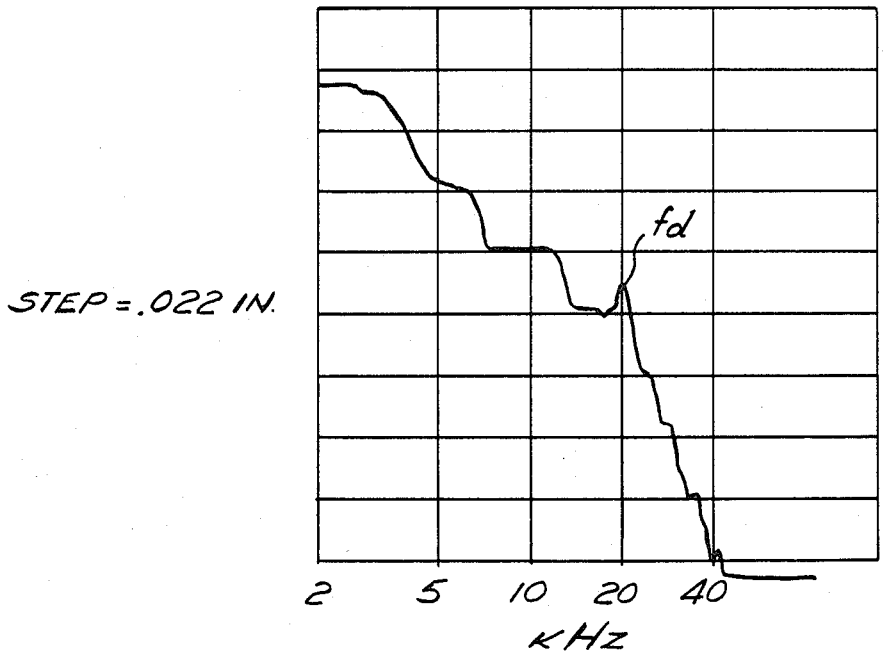
FIG. 8 is a graphic representation of the frequency response of an embodiment of the compression speaker driver having a step portion of 0.022 inches.

FIGS. 7 and 8 show the frequency response of a diaphragm constructed with step portions of 0.010 and 0.022 respectively according to the preferred embodiment of the invention. Thus when viewed in combination, FIGS. 6, 7 and 8 illustrate, how the step can be used to position the dome resonance at the most appropriate frequency. The introduction of the step portion in the diaphragm reduces the resonance frequency of the diaphragm. But, at the same time, performance of the diaphragm at frequencies below about 20 kHz is improved, particularly in the range of about 17 to 20 kHz. As frequencies above 20 kHz are inaudible to most humans, for full range performance of an audio speaker, relatively level performance at frequencies all the way up to 20 kHz is desired. Performance of the diaphragm having a step according to the preferred embodiment of the invention is considerably above that of the alternate embodiment having no step in this highest audible frequency range.

The introduction of the step in the preferred embodiment of the invention allows a controlled amount of radial movement of the perimeter of the dome portion 13 (FIG. 1). The step creates a means to adjust this resonance frequency as desired. The step can be made progressively lower until the performance illustrated in FIG. 5 is achieved. No step results in performance illustrated in FIG. 6. Any performance in between these extremes can be produced as desired.

For example, for a 1.8" diameter dome 13, a step of 0.022 inches produces a resonance frequency of approximately 20 KHz. Performance at frequencies slightly less than the resonance frequency is approximately 50% of the output at the mid-range output frequencies. In contrast, if the step is reduced to 0.010 inches, the resonance frequency is increased to approximately 25 KHz, but the frequency response of the diaphragm 11 at 20 KHz is considerably less than 50% of the response of the diaphragm 11 in the middle range of its performance. A larger step is preferred since good performance up to about 20 KHz is essential for proper reproduction of music. No value can be attached to performance above 20 KHz because of the limited ability of humans to hear frequencies above that value. The above discussion is valid for the specific material used and the specific radius of the dome chosen. Standard mathematics will readily yield accurate predictions for other materials and other curvatures.

Even in the preferred embodiment of the diaphragm of the invention output at higher frequencies above 10 kHz is reduced over the output available from a diaphragm with lower dome resonance. (FIG. 5) To compensate for this, a pure silver ring is advantageously placed around the pole piece of the driver, as is known in the art. This "shorting" ring counteracts the increase in inductive impedance with frequencies in the coil 29 to allow the driver to produce greater output at the higher frequencies with constant voltage drive.

I claim:

1. An acoustic device, comprising:
a diaphragm comprising:
a dome portion; and
an annular rim portion;
means for permitting axial movement of the dome portion of the diaphragm and for substantially preventing radial movement of the rim portion of the diaphragm; and
a step portion of the diaphragm, between the rim portion and the dome portion to permit controlled radial movement of the dome;
reinforcing means coupled to said dome portion and to said step portion to prevent the formation of localized stress points along said step portion as the dome is driven.

2. A compression speaker driver comprising:
a unitary diaphragm, comprising:
a dome portion;
a lip portion extending in a radial direction around the periphery of the dome portion; and
a step portion between the lip portion and the dome portion, substantially perpendicular to the lip portion;
a mounting plate having an opening larger than the dome portion of the diaphragm;
a planar ring of material laminated to the mounting plate and to the lip portion of the diaphragm, wherein the ring has a pair of opposed, substantially parallel faces, wherein the width of each of the faces is substantially greater than the thickness of the ring between the faces, and wherein the material and the lip portion of the diaphragm flex in an axial direction, but have substantially no flexibility in a radial direction.

3. The compression speaker driver defined in claim 2, wherein the outer dimension of the lip portion of the diaphragm is smaller than the opening in the mounting plate.

4. The compression speaker driver defined in claim 2, wherein the outer dimension of the lip portion of the diaphragm is larger than the opening in the mounting plate.

5. A compression speaker driver comprising:
a unitary diaphragm, comprising:
a dome portion;

a lip portion extending in a radial direction around the periphery of the dome portion; and a step portion between the lip portion and the dome portion, substantially perpendicular to the lip portion;

a mounting plate having an opening larger than the dome portion of the diaphragm;

a planar ring of material laminated to the mounting plate and to the lip portion of the diaphragm, wherein the ring has a pair of opposed, substantially parallel faces, wherein the width of each of the faces is substantially greater than the thickness of the ring between the faces, and wherein the inner diameter of the ring is smaller than the outer dimension of the lip portion of the diaphragm and the outer diameter of the ring is larger than the opening in the mounting plate.

6. The compression speaker driver defined in claim 5, wherein:

at least a portion of one face of the ring is bonded to the lip portion of the diaphragm to laminate the ring to the lip portion of the diaphragm; and at least a portion of the opposed face of the ring is bonded to the mounting plate to laminate the ring to the mounting plate.

7. A compression speaker driver, comprising:

a unitary aluminum diaphragm comprising:

a substantially circular dome portion;

an annular rim portion extending radially outward around the periphery of the dome; and a step portion between the rim portion and the dome portion, wherein the step portion is substantially perpendicular to the rim portion;

a mounting plate having an opening, the diameter of which is larger than the diameter of the dome portion of the diaphragm; and a ring laminated to the rim portion of the diaphragm and to the mounting plate, wherein:

the inner diameter of the ring is smaller than the outer diameter of the rim portion of the diaphragm;

the outer diameter of the ring is larger than the diameter of the mounting plate opening;

the ring has a pair of opposed, substantially parallel faces, wherein the width of each of the faces is substantially greater than the thickness of the ring between the faces so that the ring has greater flexibility in a direction substantially perpendicular to the plane of the ring than in a radial direction;

at least a portion of one face of the ring is bonded to the mounting plate; and at least a portion of the opposite face of the ring is bonded to the rim portion of the diaphragm.

8. The compression speaker driver defined in claim 7, wherein the diameter of the mounting plate opening is less than the outer diameter of the diaphragm rim.

9. The compression speaker driver defined in claim 7, wherein the diameter of the mounting plate opening is greater than the outer diameter of the diaphragm rim.

10. An acoustic device, comprising:

a diaphragm comprising:

a dome portion; and a rim portion;

means for permitting axial movement of the dome portion of the diaphragm and for substantially preventing radial movement of the rim portion of the diaphragm said means for preventing radial movement being of such a stiffness that response frequencies of at least about 20 kHz are produced; and means for permitting controlled radial movement of the perimeter of the dome portion of the diaphragm so that the resonance frequency is, controlled.

11. The compression speaker driver defined in claim 10, wherein the means for permitting radial movement of the perimeter of the dome portion comprises a step portion of the diaphragm, between the rim portion and the dome portion.

12. The compression speaker driver defined in claim 10, wherein the rim portion of the diaphragm is bonded to a mounting plate to provide the means for permitting axial movement of the dome portion and for substantially preventing radial movement of the rim portion.

13. The compression speaker defined in claim 10, wherein the means for permitting axial movement of the dome portion of the diaphragm and for substantially preventing radial movement of the rim portion of the diaphragm comprises a ring of flexible material bonded to the annular rim portion of the diaphragm and to a mounting plate.

14. A compression speaker driver comprising:

a unitary diaphragm comprising:

a dome portion; and a lip portion extending in a radial dimension around the periphery of the dome portion;

a mounting having an opening larger than the dome portion of the diaphragm; and a planar ring of material bonded to the mounting and to the lip portion of the diaphragm, wherein the ring has a pair of opposed, substantially parallel faces, wherein the width of each of the faces is substantially greater than the thickness of the ring between the faces; and wherein the inner diameter of the ring is smaller than the outer dimension of the lip portion of the diaphragm; and the outer diameter of the ring is larger than the opening in the mounting.

15. The compression speaker driver defined in claim 14 wherein:

at least a portion of the one face of the ring is bonded to the lip portion of the diaphragm; and at least a portion of the opposed face of the ring is bonded to the mounting.

* * * * *